United States Patent [19]

Lindberg

[11] 4,280,090

[45] Jul. 21, 1981

[54] TEMPERATURE COMPENSATED BIPOLAR REFERENCE VOLTAGE CIRCUIT

[75] Inventor: Charles R. Lindberg, Yorba Linda, Calif.

[73] Assignee: Silicon General, Inc., Garden Grove, Calif.

[21] Appl. No.: 131,256

[22] Filed: Mar. 17, 1980

[51] Int. Cl.[3] ..... G05F 1/56

[52] U.S. Cl. ..... 323/315

[58] Field of Search ..... 307/297; 323/4, 8, 9, 323/17, 19, 23

[56] References Cited

U.S. PATENT DOCUMENTS

| | | | |
|---|---|---|---|
| 3,646,428 | 2/1972 | Torok | 323/22 T |
| 3,794,861 | 2/1974 | Bernacchi | 323/19 X |
| 3,818,366 | 6/1974 | Arimura et al. | 323/9 X |
| 3,893,018 | 7/1975 | Marley | 323/19 |
| 3,914,683 | 10/1975 | Van de Plassche | 323/9 X |
| 4,004,244 | 1/1977 | Schade, Jr. | 323/4 X |
| 4,019,121 | 4/1977 | Feindt | 323/4 |
| 4,059,793 | 11/1977 | Ahmed | 307/297 X |
| 4,166,971 | 9/1979 | Schneider | 323/4 |
| 4,177,417 | 12/1979 | Henry et al. | 323/4 |

*Primary Examiner*—William M. Shoop
*Attorney, Agent, or Firm*—Martin R. Horn

[57] ABSTRACT

A circuit design suitable for use with monolithic semiconductor fabrication techniques which provides two accurate reference voltages, one of which is a certain calculatable percentage greater than, the other of which is the same percentage less than, a fixed reference voltage. The magnitude of this voltage window is set by selection of the value of a single resistor which is connected between a single connection point in the circuit and ground. The two accurate reference voltages are fully compensated for changes in temperature.

9 Claims, 1 Drawing Figure

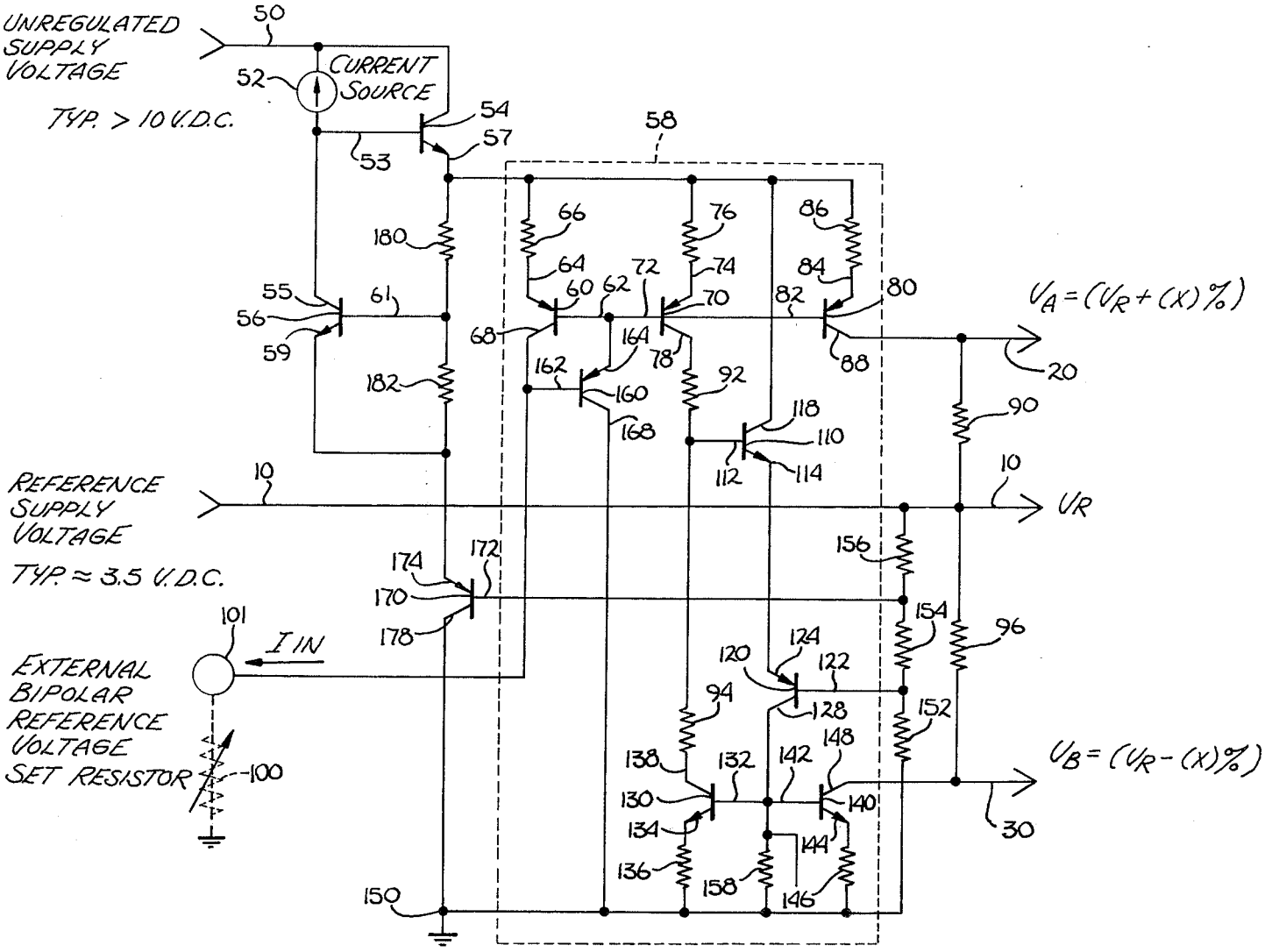
$V_A = (V_R + (x)\%)$
$V_R$
$V_B = (V_R - (x)\%)$
CURRENT SOURCE
UNREGULATED SUPPLY VOLTAGE
TYP. > 10 V.D.C.
REFERENCE SUPPLY VOLTAGE
TYP. ≈ 3.5 V.D.C.
EXTERNAL BIPOLAR REFERENCE VOLTAGE SET RESISTOR
I IN

TEMPERATURE COMPENSATED BIPOLAR REFERENCE VOLTAGE CIRCUIT

BACKGROUND OF THE INVENTION

1. Field of the Invention

This invention relates to the design of monolithic semiconductor circuits for providing highly accurate temperature compensated dual voltage references of adjustable magnitude.

2. Prior Art

In the design and fabrication of monolithic semiconductor circuits it is often desirable to have for ready availability two reference voltages each of which is a fixed percentage different from a central reference voltage, one such voltage being above the reference, the other such voltage being below the central reference. These references should be highly accurate and as nearly as possible should be temperature insensitive. Typically, the reference voltages should not vary by more than 10% of their difference from the central reference voltage for a temperature change of 100 degrees centigrade. Further, the two reference voltages should track each other very closely, such as within plus or minus 5% of the difference from the central reference voltage for the same temperature variation.

Such accuracy and stability can be achieved by use of standard negative feedback circuit design techniques. Such designs lead to relatively complicated circuits and fabrication techniques when compared to the design and fabrication of the circuit disclosed herein.

A circuit which provides for two voltages, one of which is a plus percentage, and the other of which is an equal minus percentage from a fixed reference is referred to as providing a percentage window. Various methods for the design and fabrication of such dual polarity voltage reference circuits have long been known. As an illustration, two reference voltages of 6 volts and 8 volts would form a plus and minus 1 volt window with respect to a reference of 7 volts. The most common way to set up a plus and minus percentage window would be first internally (i.e., on the monolithic chip) generate an accurate voltage reference of say 10 volts. This internal reference would be applied to an external (i.e., not on the chip) voltage divider network configured to provide the desired dual level references. For example, the 10 volts reference could be supplied to a three resistor external voltage divider comprised of the series connection of a 6 Kohm resistor and two 2 Kohm resistors. The 6 Kohm resistor would be connected to ground and the two 2 Kohm resistors would be connected in series between the 6 Kohm and the 10 volt reference. Thus at the high end of the 6 Kohm resistor would be provided a reference of 6 volts. At the junction between the two 2 Kohm resistors would be provided a reference of 8 volts. This would provide a window of plus and minus 1 volt with respect to a 7 volt reference. The 6 volts and 8 volts thus provided could then be fed back onto the monolithic chip. However, such a structure requires three external resistors and three integrated circuit connection pins on the monolithic structure (one to feed out the 10 volt reference and one each to return the 6 volt and 8 volt references).

Included among the many circuit designs for dual polarity voltage reference circuits are the designs set forth in the following United States Patents.

LaPorta et al U.S. Pat. No. 3,571,604

Nercessian et al U.S. Pat. No. 3,566,292

Torok U.S. Pat. No. 3,646,428

Saari U.S. Pat. No. 3,624,426

Marley U.S. Pat. No. 3,893,018

Of the above, those most pertinent to the invention hereinafter disclosed are believed to be the patents to Marley and Saari. Both Saari and Marley illustrate the use of the well known current mirror circuit. A current mirror is an interconnection of transistors which serve to duplicate the collector current of one of the transistors in the collectors of each of the other transistors of the current mirror. Thus by controlling the collector current of one transistor, another current of equal magnitude is caused to flow in the collectors of each other transistor in the mirror.

Marley shows one form of temperature coefficient compensation wherein the temperature coefficient of one portion of a circuit is duplicated by an equal temperature coefficient in another portion of the circuit such that the two portions of the circuit are equally affected thereby eliminating an unbalance in the two portions which would otherwise occur without the compensation.

The device of Marley shows the generation of two voltage references. However, in order to set the values of the two references, the value of at least two resistors must be determined. If it is desirable to have the two reference voltages be of equal magnitude the value of the two resistors must be equal. The device of Marley also teaches a form of temperature compensation. In order to adjust the temperature compensation characteristics of the device of FIG. 3 of Marley, the values of four separate resistors must be adjusted, although adjustment can be substantially accomplished by variation of a single resistor (R7) if that resistor is made to be a variable resistor.

Once the value of the two reference voltages are chosen, and the values of the two resistors thereby determined, and fabricated, their values cannot be readjusted. Once set, the values are fixed.

The patent to Saari shows one use of current mirror techniques to duplicate current level and shows one particular circuit configuration for supplying base current to the current mirror transistors. Saari is primarily a device for providing a current source for semiconductor circuits. Saari does not shown any temperature compensation techniques.

The various disadvantages of the referenced prior art devices are overcome by the circuit design disclosed herein. It is an object of the present invention to provide a temperature stable voltage reference circuit which provides two reference voltages, one of which is above a selected reference and another which is below the selected reference by the same amount.

It is also an object of the invention to provide such a dual level voltage reference circuit where both voltage levels are adjustable and determined by selection of a single resistor which is placed in the circuit from a single point in the circuit to ground, thereby minimizing the number of connections to the semiconductor chip that must be made to set the dual voltage reference levels.

Another object is to provide such a circuit which is suitable for use in monolithic semiconductor construction and wherein the dual voltage references are determined by the selection of a single set resistor which is external to the monolithic semiconductor structure.

Another objective is to provide a dual level voltage reference circuit, for fabrication on a monolithic semiconductor chip, which does not require an external D.C. voltage reference.

SUMMARY OF THE INVENTION

A current source provides current to drive two current mirrors. The first current mirror has an input current the magnitude of which is determined by the value of a single set resistor. The first current mirror also has two output currents which are of equal magnitude and proportional to the magnitude of the input current. One of the two output currents flows through an output resistor and thus determines one voltage reference. The second output current is used as the input current to the second current mirror.

The output current of the second current mirror is equal in magnitude to its input current, and flows through a second output resistor thereby determining the second voltage reference.

Because one output current of the first current mirror serves as the input current to the second current mirror, both output voltages are ultimately determined by the value selected for the single set resistor which sets the magnitude of the input current of the first current mirror.

The magnitude of the two output reference voltages are equal but are of opposite polarity with respect to the voltage appearing at a central reference node. For the circuit as thus far described, the magnitude of the output reference voltages will increase as the temperature of the circuit increases. In order to cause the magnitude of the reference voltages to remain constant with temperature, a compensation circuit is provided which adjusts the voltage operating point of the current source as a function of temperature. This compensation circuit causes the reference voltages to decrease for an increase in temperature. By proper adjustment of the amount of compensation, the induced decrease in output voltages will exactly cancel the temperature caused increase in output voltages. Such a circuit results in dual polarity output reference voltages which are essentially constant in magnitude over a large temperature change.

DESCRIPTION OF THE FIGURE

FIG. 1 is a circuit schematic of the preferred embodiment of a voltage reference window according to the present invention.

DETAILED DESCRIPTION OF THE INVENTION

The purpose of the circuit of FIG. 1 is to produce a first output voltage on a line 20 and a second output voltage on a line 30. The output on line 20 is a selectable percentage above the reference voltage on line 10. The output on line 30 is an equal fixed percentage below the reference voltage on line 10. The magnitude of each percentage is determined by the value of the single set resistor 100. Both voltages track one another accurately and are fully temperature compensated.

The dual polarity voltage reference circuit of FIG. 1 utilizes only open loop compensation techniques (i.e., no feedback is used) and uses current mirror circuits to control the current through, and hence voltage appearing at, the two output resistors 90 and 96 of the circuit. Both output voltage references are set by a single resistor 100 the value of which can be calculated to produce the desired output references.

Such a design is much simplified over the prior art circuits used to provide a voltage reference window to a monolithic circuit as described above. In the present design, fewer components are required and fewer connections are made than in the circuits of the prior art.

As illustrated in FIG. 1, the central reference voltage appearing on line 10 could be generated by any standard reference supply circuit. The typical value of 3.5 volts D.C. is chosen only for purposes of illustration and the magnitude of this reference has nothing to do with the principles of the circuit operation.

To produce the reference voltages on lines 20 and 30, an unregulated voltage source (not shown) provides a voltage to line 50 which should typically be greater than 10 volts D.C. This unregulated voltage on line 50 powers a current source 52. In monolithic semiconductor construction such a current source is usually a transistor-resistor pair. The exact nature of the current source is not critical for the purposes of this invention. The current source 52 supplies the drive current to the base 53 of transistor 54 and also supplies the current for the collector 55 of transistor 56.

Transistor 54 is set to operate in the emitter follower mode. The voltage gain of transistor 54 is essentially unity, but a high current is available at the emitter 57 of transistor 54. The voltage and high current available at the emitter 57 are used to drive a network 58 of current mirrors.

Transistors 60, 70 and 80 are configured to operate as a three stage current mirror. Transistor 60 has its base 62 connected to the base 72 of transistor 70 and to base 82 of transistor 80. The emitters 64, 74 and 84 of transistors 60, 70 and 80 respectively are each connected to the emitter 57 of transistor 54 through equal valued resistors 66, 76 and 86 respectively. The base 62 of transistor 60 is connected to the collector 68 of transistor 60 through the emitter to base junction of transistor 160 whose function is described below. If the current mirror transistors 60, 70 and 80 are properly biased, whatever current is caused to flow in the collector 68 will also be caused to flow in collectors 78 and 88 of transistors 70 and 80.

It is the current flowing through the collector 88, which also flows through an output resistor 90, that sets the voltage appearing on the output line 20. Thus by setting the current in collector 68 of transistor 60 the output voltage on line 20 is directly determined.

The current flowing in the collector 68 of transistor 60 may be set to the desired level by appropriate setting of the value of the external set resistor 100.

Once the value of the set resistor 100 is chosen, the same level of current that flows in collector 88 of transistor 80 will also flow in collector 78 of transistor 70. This current in collector 78 will flow through resistor 92 and resistor 94 and will be mirrored by transistors 130 and 140 so as to cause a current of equal magnitude to flow through output resistor 96 and in a direction so as to cause the voltage appearing on output line 30 to be of opposite polarity (with respect to the reference line 10) as the voltage on line 20. Because the output resistors 90 and 96 are of equal magnitude, the output voltages on line 20 and line 30 will also be of equal magnitude.

Resistors 92 and 94, which are equal to resistors 90 and 96, in conjunction with transistors 110 and 120 keep the collector to emitter voltages equal at transistor pair 70 and 80 and pair 130 and 140. This eliminates unequal collector currents attributable to transistor current gain variations vs. collector to emitter voltage and assures that the current in collector 88 of transistor 80 is identical to the current in collector 138 of transistor 130.

The current mirror transistors 130 and 140 draw their base drive current through the collector to emitter junctions of transistors 110 and 120. Transistor 110 has its base 112 connected to the junction of resistors 92 and 94. Its emitter 114 is connected to the emitter 124 of transistor 120. Its collector 118 is connected directly to the emitter 57 of transistor 54. The base current necessary to drive transistor 110 is drawn from the junction of resistors 92 and 94, but is of such a small value compared to the magnitude of current flowing through resistor 92 as to be of negligible effect thereon. At the same time base 112 of transistor 110 will hold the junction of resistors 92 and 94 at approximately the central reference voltage potential at line 10. This is analogus to resistors 90 and 96 directly attached to line 10 and again keeps the collector to emitter voltage of transistor 70 equal to that of transistor 80 and the collector to emitter voltage of transistor 130 equal to that of transistor 140 thus eliminating unequal collector currents attributed to transistor current gain variations verses collector to emitter voltage.

Transistor 130 and 140 are also connected to function as a current mirror. The input current to this current mirror is the current in collector 138. The output current is the current which is in collector 148. The base 132 of transistor 130 is connected to base 142. The emitters 134 and 144 are each connected through equal resistors 136 and 146 respectively to the same voltage potential, i.e., ground 150.

The base current necessary to drive transistor 120 is drawn from the voltage divider network comprising resistors 152, 154 and 156. The voltage on the high side of resistor 152 also sets the operating voltage of transistor 120. When transistors 110 and 120 turn on, i.e., when the voltage on base 112 of transistor 110 gets pulled up by the collector 78 of transistor 70 to approximately the central reference voltage at line 10, the current mirror transistors 130 and 140 are caused to draw their base current from emitter 57 down through the collector-emitter junction of transistor 110 and the emitter collector junction of transistor 120.

Resistor 158 keeps the collector 128 to base 122 leakage current from turning on transistors 130 and 140 at elevated temperatures.

Once the current in collector 78 is accurately reflected to collector 138, the current mirror configuration of transistors 130 and 140 causes a current of equal magnitude to flow through the collector 148 of transistor 140. This current flows through resistor 96 and establishes a voltage on output line 30 which is less than the voltage on line 10 by an amount which is equal to that amount by which the voltage on line 20 exceeds the voltage on line 10.

From the above description it is clear that by selecting a value for the set resistor 100 a current of a desired value can be caused to flow in the collector 68 which current will be mirrored forward to the collector 88. This same magnitude of current will flow through the output resistor 90 so as to generate a voltage on line 20. The current in collector 68 will also be reflected through collector 78 to collector 138 and eventually to collector 148 and thus cause a current of equal magnitude to travel through output resistor 96. This will generate a voltage on line 30. The voltage on line 20 will be above the voltage on line 10 by an amount equal to that by which the voltage on line 30 is below the voltage on line 10. This gives the desired dual output reference voltage window.

The design of the current mirror comprising transistors 60, 70 and 80 differs from the conventional design of current mirrors in one very important aspect. In the conventional design the common base of the transistors is connected directly to the collector of the first transistor in the mirror. Thus the mirror transistors obtain their base drive current from the input current to the mirror, i.e., I in as shown in the figure. However, in the circuit of the present invention the amount of current necessary to drive the bases is not insignificant when compared to the input current I in. To permit the base drive current to be taken from the current flowing in the collector 68 would introduce undesirable error into that collector current. That error would be mirrored to the collectors 88 and 148 and adversely affect the accuracy of the reference voltages on lines 20 and 30.

To minimize this error, transistor 160 is used to isolate bases 62, 72 and 82 from collector 68 of transistor 60. The current in the base 162 required to turn transistor 160 ON is negligible compared to the current in collector 68 and hence produces negligible error in the reference voltages on lines 20 and 30. When transistor 160 is turned ON, the drive current to bases 62, 72 and 82 is supplied directly from ground 150 through the collector 168 to emitter 164 junction of transistor 160 rather than being subtracted from the current in collector 68.

The electrical characteristics of monolithic semiconductor components vary with temperature. Those components whose temperature sensitivity is most critical to the design of the present invention are transistors 60 and 160 and resistors 90 and 96. The value of resistance of resistors 90 and 96 tends to increase at the rate of approximately 0.16% per degree centrigrade temperature rise. Obviously a change in the value of resistors 90 or 96 will degrade the accuracy of the reference voltages on lines 20 and 30. The base to emitter voltage drop of transistors 60 and 160 is also temperature dependent and will have an effect on the output reference voltages on lines 20 and 30. By lumping these and other minor effects together, it is possible to compute the net effect on the output reference voltages (on lines 20 and 30) as a function of variation in temperature.

With respect to the current mirror network 58 and the resistors 90, 96, 152, 154 and 156 it can be shown that the difference between the central reference voltage on line 10 and each of the two reference voltages on lines 20 and 30 will increase with temperature. This net positive temperature coefficient of the reference voltages is undesirable. To counter this positive temperature coefficient, negative temperature coefficient may be generated by reducing the voltage level at the emitter 57 of transistor 54. By reducing the voltage on emitter 57 a smaller current will result in the collector 68 and hence in collectors 88 and 148 as well for a given value of set resistor 100. By proper adjustment of the amount of negative temperature coefficient the decrease in current through collectors 88 and 148 will exactly compensate for the positive temperature coefficients discussed in the previous paragraph. Proper balancing of temperature coefficients will result in the product of current (through collectors 148 or 88) and resistance (resistors 96 and 90 respectively) being held constant. Hence the output voltages on line 20 and 30 will be constant over a wide variation in temperature.

This reqired negative temperature coefficient is supplied via transistors 170 and 56 in combination with resistors 180 and 182. Resistors 180 and 182 are connected in series between the emitter 57 of transistor 54 and emitter 174 of transistor 170. The collector 178 of transistor 170 is connected to ground 150. The base 172 of transistor 170 has its operating voltage set by the simple voltage divider circuit made up of resistors 152, 154, and 156. Transistor 170 serves to set the operating voltage for transistor 56 and also provides a small negative temperature coefficient to the voltage appearing at emitter 57.

Transistor 56 has its collector 55 connected to the base 53 of transistor 54. Its emitter 59 is connected to the emitter 174 of transistor 170. The base 61 of transistor 56 is connected to the junction of resistors 180 and 182. Transistor 56 is configured to operate as a multiplier of its base 61 to emitter 59 voltage change as a function of temperature. The base 61 to emitter 59 voltage drop of transistor 56 decreases as temperature increases. This decrese is multiplied by the ratio of resistor 180 to resistor 182 and changes the voltage appearing on the base 53 of transistor 54 so as to change its operating point and reduce the voltage level at emitter 57. This decrease in voltage at emitter 57 translates into a decrease in the current level in collector 68 (for a given value of set resistor 100). This causes the current in collector 88 to decrease which tends to cause a decrease in voltage on line 20. This compenstes for the net tendency of the current mirrior network 58 to increase the voltage appearing on line 20 as discussed above. By proper selection of the ratio of resistors 180 and 182 the amount of temperature compensation is adjusted. Proper adjustment results in a negligible change in voltage on lines 20 and 30 with temperature changes. In the preferred embodiment it has been found that a net zero temperature sensitivity will result for a ratio of resistor 180 to resistor 182 on the order of 14 to 3. Thus resistor 180 was 14 Kohms and resistor 182 was 3 Kohms.

There has thus been provided a very accurate dual level voltage reference circuit. The first reference voltage is a selectable magnitude above a reference supply voltage and the second reference voltage is that same magnitude below the reference supply voltage. The magnitude of difference from the reference supply voltage for each dual level reference voltage is variable and determined by selection of the value of resistance of a single set resistor. The single external set resistor is connected between ground and a single point 101 in the circuit on the monolithic semiconductor chip. The dual level output voltages are fully temperature compensated by balancing the predictable positive and negative temperature coefficients of the electronic components that are used in the silicon monolithic processes. The amount of such compensation is adjustable by adjustment of the ratio of two resistors.

This circuit exhibits excellent temperature stability and produces dual output voltages which track each other closely. The number of connections to the monolithic semiconductor chip are absolutely minimized to a single connection.

While the above invention has been described with reference to the particular embodiment of FIG. 1, various changes, modifications and additions thereto could be made by a person of ordinary skill in the art without departing from the spirit and scope of the invention. As is typical in fabrication of semiconductors the same result can be achieved by replacing NPN transistors with PNP and vice versa and changing the polarity of all reference voltages. The particular embodiment disclosed is not to be read as limiting the scope of the invention as disclosed herein which is defined by the appended claims.

I claim:

1. An electronic circuit for generating a first reference voltage and a second reference voltage, said first reference voltage and said second reference voltage being equal in magnitude but of opposite polarity with respect to a reference supply voltage, said electronic circuit comprising:

a source of electrical current;

a first means for duplicating current coupled to said source of electrical current and having output current and input current, said first means being so configured that said output current is proportional in magnitude to said input current;

a second means for duplicating current coupled to said source of electrical current and to said first means for duplicating current, and having output current and input current, said second means being so configured that said output current is proportional in magnitude to said input current;

said input current of said second means being an output current of said first means;

output current of said first means flowing through a first resistor so as to generate said first reference voltage;

output current of said second means flowing through a second resistor so as to generate said second reference voltage; and a single and selectable resistor coupled to said first means for duplicating current whereby selection of a value of resistance for said resistor determines the magnitude of said first and second reference voltages.

2. The electronic circuit according to claim 1 wheein said first means comprises a current mirror circuit, including a plurality of transistors, and having an input current and a plurality of output currents; and said second means comprises a current mirror circuit, including at least two transistors, and having an input current and an output current.

3. The electronic circuit according to claim 2 wherein the drive current supplied to the base of said plurality of transistors of the first means is supplied from ground through the collector to emitter junction of a transistor whose base is driven by a portion of the collector current of one of said plurality of transistors.

4. The electronic circuit according to claim 2 wherein the drive current supplied to the base of said two transistors of said second means is supplied from said source of electrical current through the collector to emitter junction of a first transistor through the emitter to collector junction of a second transistor.

5. The electronic circuit according to claim 2 wherein one of said plurality of transistors of said first means has its collector coupled through a first series connection of two equal valued resistances to the collector of one of said at least two transistors of said second means;

another of said plurality of transistors of said first means has its collector coupled through a second series connection of two equal valued resistances to the collector of another of said at least two transistors of said second means; and said resistors of said first series connection are equal in value to said resistors of said second series connection.

6. The electronic circuit according to claim 2 wherein each of said plurality of transistor of said first means is either of the NPN or PNP type, and the transistors of said second means are of the opposite type.

7. The electronic circuit according to claim 1 wherein the magnitude of said first reference voltage and second reference voltage varies with temperature change, and further comprising:

compensation means coupled to said source of electrical current for adjusting the voltage operating point of said source of electrical current as a function of temperature and in a manner so as to counter the changes with temperature in the magnitude of said first and second reference voltages and thereby cause said first and second reference voltages to be substantially of constant magnitude over wide changes in temperature.

8. The electronic circuit according to claim 7 wherein said compensation means comprises a first transistor having its collector coupled to said source of electrical current and configured so at to multiply its temperature dependent based to emitter voltage drop and thereby adjust the voltage operating point of said source of electrical current as a function of temperature.

9. The electronic circuit according to claim 8 wherein said current source is coupled to a first transistor operating in the emitter follower mode and said compensation means comprises:

a first transistor the collector of which is connected to the base of said emitter follower, the base of which is connected through a first resistor to the emitter of said emitter follower and connected through a second resistor to its own emitter and to the emitter of a second transistor;

said second transistor serving to establish the operating voltage of said first transistor, and has its collector connected to ground.

* * * * *